United States Patent [19]

Boyer et al.

[11] Patent Number: 4,734,721

[45] Date of Patent: Mar. 29, 1988

[54] ELECTROSTATIC PRINTER UTILIZING DEHUMIDIFIED AIR

[75] Inventors: Alan H. Boyer, East Sullivan; Graham D. Walter, Peterborough; Robert A. Moore, Amherst, all of N.H.

[73] Assignee: Markem Corporation, Keene, N.H.

[21] Appl. No.: 784,506

[22] Filed: Oct. 4, 1985

[51] Int. Cl.[4] ..... G03G 15/00

[52] U.S. Cl. ..... 346/159; 355/30

[58] Field of Search ..... 346/154; 355/3 CH, 30; 313/432, 11, 28; 219/216 PH; 361/225, 230; 400/114; 101/DIG. 13; 358/300; 365/118

[56] References Cited

U.S. PATENT DOCUMENTS

| | | | |
|---|---|---|---|
| 2,225,247 | 12/1940 | Kline et al. | 346/159 |
| 2,868,989 | 1/1959 | Haacke | 346/159 |
| 2,885,556 | 5/1959 | Gundlach | 346/159 |
| 2,931,688 | 4/1960 | Innes et al. | 346/159 |
| 3,023,070 | 2/1962 | Benn | 346/159 |
| 3,195,142 | 7/1965 | Benn et al. | 346/159 |
| 3,213,461 | 10/1965 | Goddard | 346/159 |
| 3,324,291 | 6/1967 | Hudson | 346/159 |
| 3,382,360 | 5/1968 | Young et al. | 346/159 |
| 3,495,269 | 2/1970 | Mutschler et al. | 346/159 |
| 3,496,352 | 2/1970 | Jugle | 346/159 |
| 3,545,374 | 12/1970 | Hendricks, Jr. | 346/159 |
| 3,606,531 | 9/1971 | Gourdine | 346/159 |
| 3,646,351 | 2/1972 | Jarvis | 346/159 |
| 3,665,181 | 5/1972 | Cobb | 346/159 |
| 3,689,935 | 9/1972 | Pressman et al. | 346/159 |
| 3,715,762 | 2/1973 | Magill et al. | 346/159 |
| 3,725,951 | 4/1973 | McCurry | 346/159 |
| 3,742,516 | 6/1973 | Cavanaugh et al. | 346/159 |
| 3,779,166 | 12/1973 | Pressman et al. | 346/159 |

(List continued on next page.)

FOREIGN PATENT DOCUMENTS

| | | | |
|---|---|---|---|
| 53-125839 | 11/1978 | Japan | 346/159 |
| 53-136830 | 11/1978 | Japan | 346/159 |
| 59-204055 | 11/1984 | Japan | 346/159 |
| 1309449 | 3/1973 | United Kingdom | 346/159 |
| 1309664 | 3/1973 | United Kingdom | 346/159 |

OTHER PUBLICATIONS

R. R. Thettu et al., "Corona Device with Reduced Ozone Emission", *Xerox Disclosure Journal,* vol. 1, No. 3, p. 59 (Mar. 1976).

T. J. Hammond et al., "Corona Device", *Xerox Disclosure Journal,* vol. 1, No. 3, p. 61 (Mar. 1976).

C. D. Wilson, "Air Conditioning of Xerographic Reproduction Machines", *Xerox Disclosure Journal,* vol. 1, No. 7, p. 69 (Jul. 1976).

J. W. Laing, "The Ion Chemistry of Corona Discharges in Air", Annual Reprographic Conference on Electrical Insulation and Dielectric Phenomena, Oct. 21–24, 1979.

W. J. Bernardelli et al., "Corona Contamination Reduction", *IBM Technical Disclosure Bulletin,* vol. 23, No. 9, pp. 4037–4038 (Feb. 1981).

J. M. Adley et al., "Corona Design with Ozone Ducts", *IBM Technical Disclosure Bulletin,* vol. 26, No. 3A, p. 1024 (Aug. 1983).

R. E. McCurry, "Direct Ionic Printer-Plotter", *IBM Technical Disclosure Bulletin,* vol. 15, No. 1, p. 275 (Jun. 1972).

H. B. Dean, "Corona Apparatus", *IBM Technical Disclosure Bulletin,* vol. 17, No. 9, p. 2745 (Feb. 1975).

G. L. Harpavat et al., "Arrangement for Preventing Dirt Accumulation on Corona Discharge Devices", *Xerox Disclosure Journal,* vol. 1, No. 3, p. 57 (Mar. 1976).

*Primary Examiner*—Arthur G. Evans

*Attorney, Agent, or Firm*—Robbins & Laramie

[57] ABSTRACT

An electrostatic print head system is disclosed which comprises an ion modulated electrostatic print head, a means for supplying unheated dehumidified air having a relative humidity of less than about 20 percent at or near ambient temperature, and a means for directing the print head may comprise a modulated aperture board having a plurality of selectively controlled apertures therein and an ion generator for providing ions for electrostatic projection through the apertures. The electrostatic print head system may be used for forming latent electrostatic images and employed in an electrostatic printer which further comprises a means for developing the latent electrostatic images.

12 Claims, 8 Drawing Figures

U.S. PATENT DOCUMENTS

| | | | |
|---|---|---|---|
| 3,862,420 | 1/1975 | Banks et al. | 346/159 |
| 3,878,469 | 4/1975 | Bolasny | 346/159 |
| 3,978,492 | 8/1976 | Simm | 346/159 |
| 3,979,759 | 9/1976 | Simm | 346/159 |
| 4,016,813 | 4/1977 | Pressman et al. | 346/159 |
| 4,030,106 | 6/1977 | Bestenreiner et al. | 346/159 |
| 4,040,731 | 8/1977 | Nishikawa | 346/159 |
| 4,050,377 | 9/1977 | Watanabe et al. | 346/159 |
| 4,105,444 | 8/1978 | Shinohara et al. | 346/159 |
| 4,117,778 | 10/1978 | Watanabe et al. | 346/159 |
| 4,124,854 | 11/1978 | Kirtikar | 346/159 |
| 4,152,747 | 5/1979 | Fisher | 346/159 |
| 4,160,257 | 7/1979 | Carrish | 346/159 |
| 4,281,334 | 7/1981 | Moore et al. | 346/159 |
| 4,281,335 | 7/1981 | Moore et al. | 346/159 |
| 4,338,614 | 7/1982 | Pressman et al. | 346/159 |
| 4,347,525 | 8/1982 | Moore et al. | 346/159 |
| 4,353,970 | 10/1982 | Dryczynski et al. | 346/159 |
| 4,357,,618 | 11/1982 | Ragland | 346/159 |
| 4,408,214 | 10/1983 | Fotland et al. | 346/159 |
| 4,463,363 | 7/1984 | Gundlach et al. | 346/159 |
| 4,563,081 | 1/1986 | Sato | 355/3 CH |
| 4,591,885 | 5/1986 | Day et al. | 346/159 |
| 4,619,515 | 10/1986 | Maczuszenko et al. | 346/159 |

ELECTROSTATIC PRINTER UTILIZING DEHUMIDIFIED AIR

BACKGROUND OF THE INVENTION

1. Field of the Invention

The present invention relates generally to an electrostatic printer which utilizes dehumidified air to extend print head lifetime and to an electrostatic imaging process involving the utilization of dehumidified air.

2. Description of the Prior Art

In a typical electrostatic imaging process, a latent electrostatic image is formed on a dielectric charge retentive surface using a non-optical means, such as an electrostatic print head which generates ions by the corona discharge from a small diameter wire or point source. The dielectric surface can be either on the final image recording or receiving medium or on an intermediate transfer element, such as cylindrical drum.

The latent electrostatic image is then developed by depositing a developer material containing oppositely charged toner particles. The toner particles are attracted to the oppositely charged latent electrostatic image on the dielectric surface. If the dielectric surface is on the final recording medium, then the developed image can be fixed by applying heat and/or pressure. If the dielectric surface is on an intermediate transfer element, however, then the developed image must first be transferred to the final recording medium, for example plain paper, and then fixed by the application of heat and/or pressure. Alternatively, the developed image may be fixed to the final recording medium by means of the high pressure applied between the dielectric-coated transfer element and a pressure roller, between which the final recording medium passes.

The intermediate transfer element in an offset electrostatic imaging process is typically a cylindrical drum made from an electrically conductive, non-magnetic material, such as aluminum or stainless steel, which is coated with a dielectric material. Suitable dielectric materials include polymers, such as polyesters, polyamides, and other insulating polymers, glass enamel, and aluminum oxide, particularly anodized aluminum oxide. Dielectric materials such as aluminum oxide are preferred to layers of polymers because they are much harder, and therefore, are not as readily abraded by the developer materials and the high pressure being applied. Metal oxide layers prepared by a plasma spraying or detonation gun deposition process have been particularly preferred as dielectric layers because they are harder and exhibit longer lifetimes than layers prepared using other processes.

One major problem encountered with currently available electrostatic printers of the ion deposition screen type has been the limited lifetime of the electrostatic aperture board. These types of electrostatic printers are disclosed in U.S. Pat. Nos. 3,689,935, 4,338,614 and 4,160,257. Such electrostatic printers have a row of apertures which selectively allow ionized air to be deposited onto a dielectric surface in an imagewise dot matrix pattern. It has been observed that a chemical debris tends to build up around the apertures and on the corona wire as a function of time and the humidity of the air. This chemical debris was found to be a crystalline form of ammonium nitrate. This particular chemical is created when air containing water molecules, such as is generally encountered, is ionized.

A number of methods have been suggested for alleviation of this problem of contaminant buildup. It has been suggested that the air being supplied to the corona discharge device first be filtered through a filter for ammonia in order to prevent the formation of ammonium nitrate. This method has not been found to be effective because it does not remove the water molecules in the air which under the influence of a corona discharge and in combination with other components of air form precursors to ammonium nitrate. Another method suggested for inhibiting formation of ammonium nitrate in an ion generator which includes a glow discharge device is to heat the glow discharge device above its intrinsic operating temperature at or near the ion generation sites.

SUMMARY OF THE INVENTION

In accordance with the present invention, the operational lifetime of an ion modulated electrostatic print head can be prolonged by an order of magnitude by passing unheated dehumidified air at, near or through the print head.

An electrostatic print head system in accordance with the present invention comprises an ion modulated print head, a means for supplying unheated dehumidified air at or near ambient temperature having a relative humidity of less than about 20 percent, and preferably, less than about 5 percent, at or near ambient temperature, and a means for directing the dehumidified air at, near or through the print head. In a preferred embodiment, the print head comprises a modulated aperture board having a plurality of selectively controlled apertures therein and an ion generator for providing ions for electrostatic projection through the apertures. In this embodiment, the dehumidified air is directed at or near the ion generator and at, near or through the apertures. In a particularly preferred embodiment, the apertures function to cut off the flow of ions and the ion generator is a corona wire.

In a further aspect, the present invention relates to an electrostatic printer which comprises an ion modulated electrostatic print head for forming latent electrostatic images, a means for developing the latent electrostatic images, a means for supplying unheated dehumidified air, and a means for directing such air at, near or through the print head.

An ion generator in accordance with the present invention comprises a means for generating ions, a means for supplying unheated dehumidified air, and a means for directing such air at, near or through the means for generating ions. In a preferred embodiment, the means for generating ions is a corona generator, and in a particularly preferred embodiment, the corona generator is a corona wire.

The process of the present invention comprises the steps of forming a latent electrostatic image on a dielectric imaging surface, such as a sheet of dielectric paper capable of receiving a latent electrostatic image, using an ion modulated electrostatic print head, developing the latent electrostatic image, providing unheated dehumidified air, and directing it at, near or through the print head.

When unheated dehumidified air having a relative humidity of less than about 20 percent, and preferably, less than about 5 percent, is used, the lifetime of the electrostatic printer can be extended significantly. It has been found that the use of such dehumidified air substantially inhibits the formation of ammonium nitrate around the ion generator and the apertures by removing the water molecules in the air which in combination with other components of air and under the influence of a corona discharge form precursors to ammonium nitrate, such as nitric acid and ammonia. The use of unheated dehumidified air also reduces oxidation of the electrodes used to control the apertures, and provides for more uniform deposition of ions across the print head.

BRIEF DESCRIPTION OF THE DRAWINGS

The various objects, advantages and novel features of the invention will be fully appreciated from the following detailed description when read in conjunction with the appended drawings, in which.

Throughout the drawings, like reference numerals will be used to identify like parts.

DETAILED DESCRIPTION OF THE PREFERRED EMBODIMENTS

Figure 1:
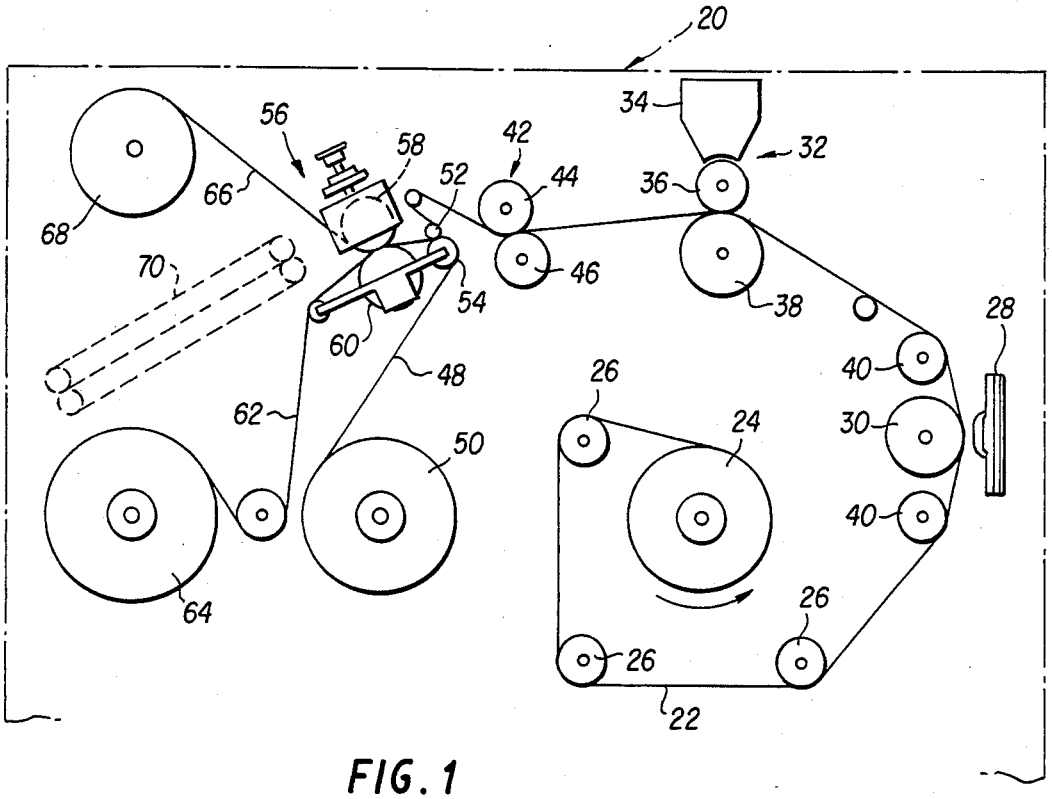
FIG. 1 illustrates an electrostatic label printing system in which the present invention may be employed.

FIG. 1 illustrates an electrostatic label printing system 20 with which the present invention may advantageously be employed. A web 22 of dielectric-coated paper is fed from a supply reel 24 and is carried by a number of guide rolls 26 to an electrostatic print head 28. The guide rolls 26 provide a long path for the web 22 to travel before reaching the print head 28 and hence reduce printing errors due to side-to-side wandering of the web. The electrostatic print head 28, which will be described in more detail hereinafter, contains an internal corona source and a number of electrically controlled apertures for controlling the passage of the corona ions to the dielectric surface of the web 22. A conductive backup roll 30 is provided on the opposite (i.e., uncoated) side of the web in order to support the web and to provide an accelerating potential for the ions produced by the corona wire. The print head 28 deposits a latent image on the web 22 consisting of electrostatic charges in a dot-matrix pattern. In order to render the latent image visible, the web 22 is passed through a toner unit 32 consisting of a hopper or toner reservoir 34, a magnetic brush applicator roll 36 and a backup roll 38. Grounded rolls 40 are positioned in contact with the uncoated side of the web 22 on either side of the backup roll 30 in order to dissipate stray charges which would otherwise result in overtoning of the latent image. After passing through the toner unit 32, the web 22 moves through a fuser station 42 which comprises a pair of opposing steel pressure rolls 44, 46. The pressure rolls 44, 46 cause the toner material to bond to the surface of the web 22 and thereby render the visible image permanent. The fuser rolls 44, 46 are driven by a synchronous motor and serve not only to fix the image but also to draw the web 22 through the printing station 28 and toner unit 32 at a constant velocity.

With further reference to FIG. 1, the web emerging from the fuser station 42 now carries a permanent visible image on its coated side. The label indicia may consist, for example, of alphanumeric data in combination with UPC bar codes identifying a product to which the finished label will be applied. In order to allow the label to adhere to the desired surface, an adhesive backing strip 48 is delivered from an adhesive suppy reel 50 and is bonded to the uncoated side of the web 22 by means of a pair of roller 52, 54. The resulting two-layer label strip is passed through a cutting station 56 consisting of a rotary cutter 58 and a backing roll 60. The cutting station 56 may be arranged to operate in one of two modes. In the butt cutting mode, the printed paper layer is cut straight across to define individual labels on the uncut backing layer. The finished label strip 62, consisting of the printed and cut webs 22 laminated on the uncut backing strip 48, is then rewound on a label rewind reel 64. In the die cutting mode, the paper layer is cut completely around the printed label areas to define individual labels having a desired shape, and the backing layer is again left uncut. The die cutting operation produces a waste strip 66 consisting of the portions of the cut paper layer outside the label areas, and this waste strip is rewound on independently driven waste rewind reel 68. The finished label strip 62, consisting of the individual cut labels carried by the uncut backing strip, is rewound on independently driven label rewind reel 64.

The label printing system 20 may also be operated without the adhesive backing supply reel 50 in cases where it is desired to produce cut labels in sheet form without any adhesive backing. In this embodiment, the sheet labels are removed from the cutting station 56 by a label transport mechanism 70 consisting of a pair of endless belts in facing relationship.

A computer (not shown) controls the formatting of data to the electrostatic print head 28 as well as the various other functions of the printing system 20. Proper synchronization between the printing station 28 and cutting station 56 is achieved by means of an angular position sensor at the cutting station. The details of this arrangement may be found in U.S. Pat. Nos. 4,281,334 and 4,281,335, issued to Robert A. Moore et al. on July 28, 1981, and in U.S. Pat. No. 4,347,525, issued to Robert A. Moore et al. on Aug. 31, 1982. The foregoing patents are expressly incorporated by reference herein.

Figure 4:
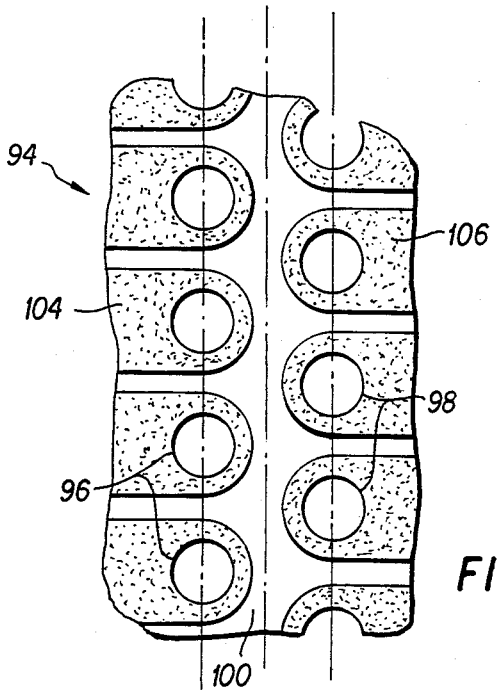
FIG. 4 is a still further enlarged view of the aperture electrodes carried by the aperture mask.
Figure 2:
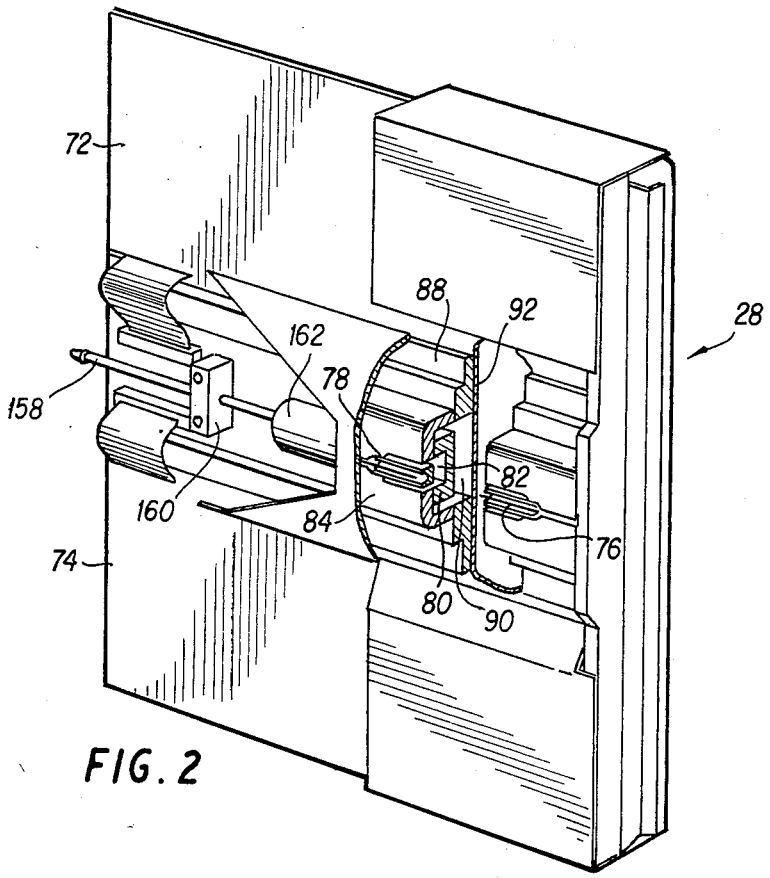
FIG. 2 is perspective view of the electrostatic print head, with portions cut away to illustrate certain internal details.
Figure 3:
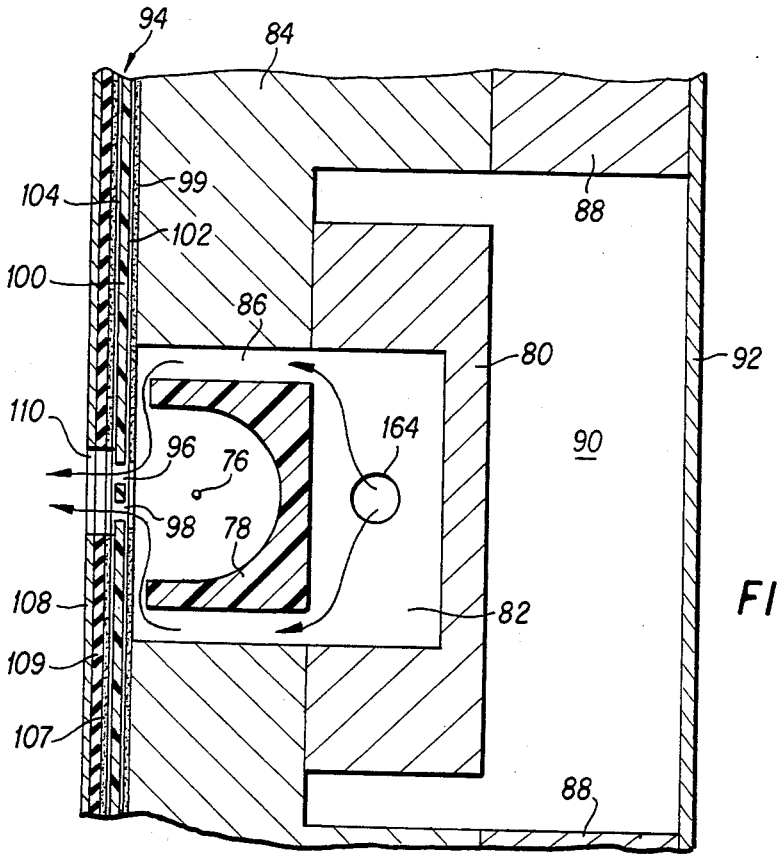
FIG. 3 is an enlarged sectional view of the corona wire and aperture mask assembly of the print head.

FIG. 2 is a perspective view of the electrostatic print head 28 with portions cut away to illustrate certain internal details. FIG. 3 is an enlarged sectional view of the corona wire and aperture mask assembly of the print head, and FIG. 4 is a still further enlarged view of the aperture electrodes carried by the aperture mask. The print head 28 is of the type disclosed and claimed in U.S. Pat. No. 3,689,935, issued to Gerald L. Pressman et al. on Sept. 5, 1972 and U.S. Pat. No. 4,016,813, issued to Gerald L. Pressman et al. on Apr. 12, 1977, both of these patents being expressly incorporated herein by reference. The print head 28 also embodies certain improvements disclosed and claimed in U.S. Pat. No.

4,338,614, issued to Gerald L. Pressman et al. on July 6, 1982 and also incorporated herein by reference.

The print head 28 of FIG. 2 generally comprises a pair of electrical circuit boards 72, 74 mounted on either side of a centrally-located corona wire and aperture mask assembly. The corona wire 76 is enclosed within an elongated conductive corona shield 78 which has a U-shaped cross-section. The corona shield 78 is supported at each of its two ends by a manifold block 80 that is formed with an oblong central cavity 82. The manifold block 80 is nested within a mask support block 84 which is generally C-shaped in cross-section. The mask support block 84 is formed with an oblong central opening 86 which registers with the cavity 82 in the manifold block 80 and receives the corona shield 78. The mask support block 84 is secured at its edges to a print head slider 88, the latter being the primary supporting structure of the print head 28 and carrying the two circuit boards 72, 74. The print head slider 88 is formed with a large central cut-out 90 and is secured to driver board 92.

The corona shield 78 is positioned in facing relationship with an aperture mask formed by a flexible circuit board 94. Referring particularly to FIGS. 3 and 4, the circuit board 94 is formed with two staggered rows of apertures 96, 98 extending parallel to the corona wire 76 and transverse to the direction of movement of the web 22 in FIG. 1. Positive ions produced by the corona wire 76 are induced to pass through the apertures 96, 98 under the influence of an accelerating potential which is maintained between the corona wire 76 and the backup roll 30 of FIG. 1. The flexible circuit board 94 includes a central insulating layer 100 and carries a continuous conductive layer 102 on the side facing the corona wire 76. The opposite side of the insulating layer 100 carries a number of conductive segments 104, 106 associated with the individual apertures 96, 98 as shown in FIG. 4. Circuit board 94 is secured to mask support block 84 by a thin layer of adhesive 99 and to slotted focus plane 108 by an insulating adhesive layer 109. Circuit board 94 is overlaminated with a thin insulating layer 107. In operation, individual potentials are applied between the conductive segments 104, 106 and the continuous conductive layer 102 in order to establish local fringing fields within the apertures 96, 98. As described in the aforementioned U.S. Pat. Nos. 3,689,935 and 4,016,813, these fringing fields can be used to block or permit the flow of ions from the corona wire 76 to the dielectric-coated web 22 of FIG. 1 through selected ones of the apertures 96, 98. The apertures are controlled by appropriate electronics carried by the circuit boards 72, 74. As explained in the aforementioned U.S. Pat. No. 4,338,614, the performance of the print head may be enhanced by interposing a slotted focus plane made of a conductive material between the modulated apertures 96, 98 and the dielectric-coated web 22. The slotted focus plane is illustrated at 108 in FIG. 3, with the slot 110 aligned with the aperture rows 96, 98.

In practice, it has been found that deposits of ammonium nitrate form in and around the apertures 96, 98, principally on the side facing the corona wire 76. Some deposits also form on the corona wire itself, thereby reducing its output and producing a non-uniform corona. After the print head has been in operation for about 50–75 hours, the deposits of ammonium nitrate in and around the apertures 96, 98 begin to restrict the flow of ions through the apertures. The effect on output can be counteracted somewhat by increasing the potential on the corona wire 76, but eventually a point is reached at which the apertures become substantially completely blocked. When this occurs, the print head 28 must be removed from the printing apparatus and the flexible circuit board 94 carrying the apertures 96, 98 must be replaced. The flexible circuit board 94 is rather difficult and expensive to manufacture, since it must be etched with a pattern of fine, closely-spaced conductors for controlling the individual apertures. Therefore, frequent replacement of this component is undesirable.

Figure 5:
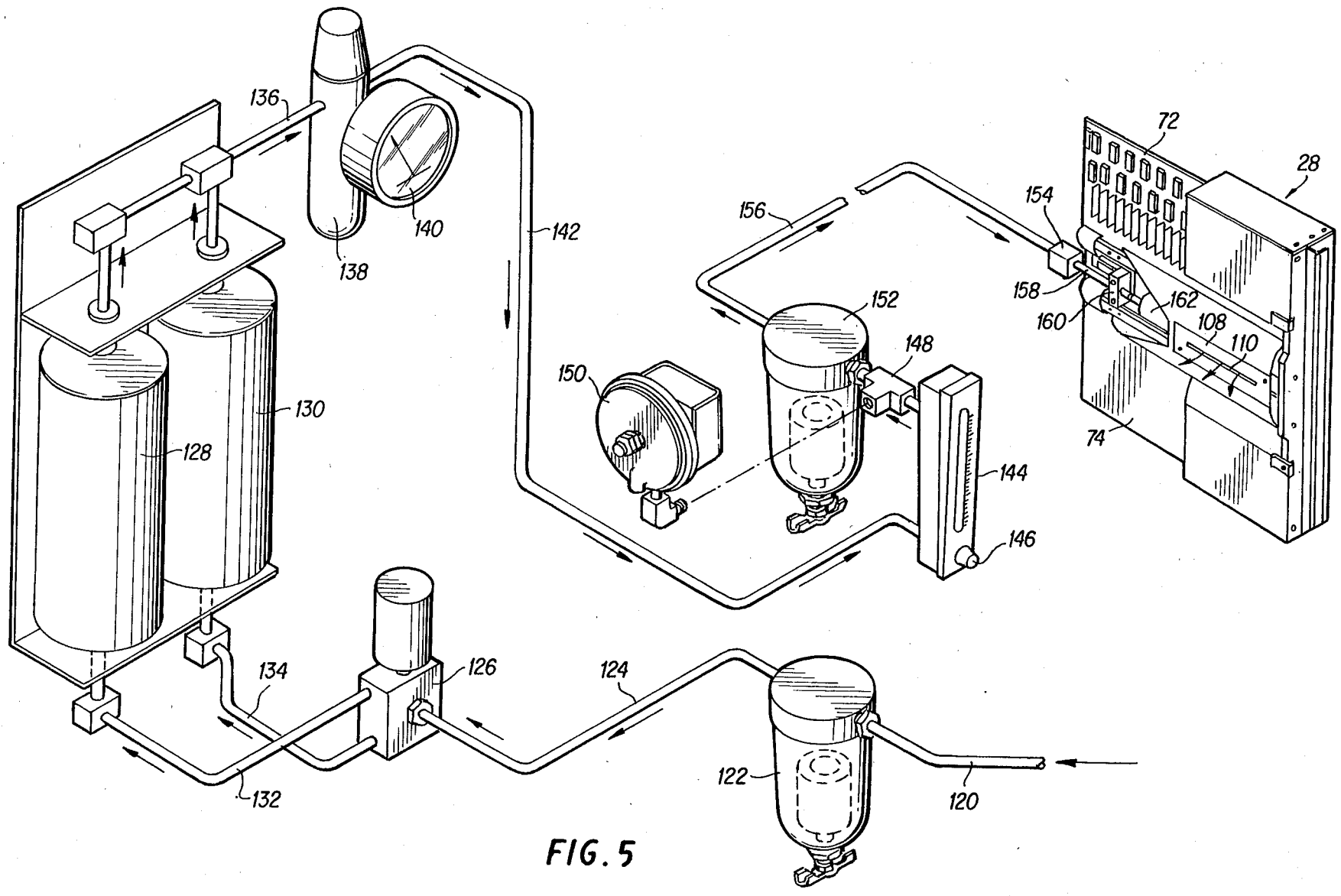
FIG. 5 illustrates the system which is used to supply dehumidified air to the electrostatic print head.

In accordance with the present invention, a flow of dehumidified air at or near ambient temperature is provided through the electrostatic print head 28 in order to inhibit the formation of ammonium nitrate in and around the apertures 96, 98 and on the corona wire 76. An exemplary system for supplying dehumidified air to the print head 28 is illustrated in FIG. 5. Compressed air at a minimum of 80 psi and generally about 80–100 psi enters the system through a section of tubing 120 and is conducted to the input side of a coalescing oil filter 122. The coalescing oil filter operates to remove any oil or water droplets which may be present in the source of compressed air. The output side of the filter 122 is connected by means of a further length of tubing 124 to a timer-operated solenoid valve 126. The solenoid valve is part of a commercially available air dryer system which also includes a pair of desiccant towers 128, 130. A suitable system of this type is the Model 311B air dryer manufactured by O'Keefe Controls Company of Monroe, Conn. The solenoid valve 126 operates on a 30-second cycle and directs the compressed air through the lengths of tubing 132, 134 and desiccant towers 128, 130 in an alternating manner. During each 30-second cycle, one of the desiccant towers is supplying dehumidified air to the output tubing 136 and the other desiccant tower is receiving a backflow of dehumdified air from the first tower in order to regenerate the desiccant material within the inoperative tower. Humid air from the tower being regenerated is discharged from the system through an exhaust muffler.

Dehumidified air from the output of the air dryer system passes through tubing 136 to an output regulator 138 which controls the air pressure to the print head 28. A gage 140 allows the air pressure at the output of the regulator 138 to be monitored. From the output of the regulator 138, the dehumidified air passes via tubing 142 to the input side of an adjustable flow meter 144 of the floating ball type. In the preferred embodiment, the flow meter 144 set to provide an air flow of about 41 cubic feet per hour to the electrostatic print head 28. A knob 146 on the flow meter allows the flow rate of the dehumidified air to be adjusted if necessary.

The output side of the flow meter 144 is connected via a short length of tubing to a tee 148, one output of which is connected to a pressure sensor 150. The function of the pressure sensor 150 is to insure that adequate air pressure is being provided to the print head 28, and to interrupt the operation of the print head when this condition is not satisfied. The second output of the tee 148 is connected to the input side of a hydrocarbon filter 152. The output side of the hydrocarbon filter 152 is connected via a length of flexible tubing 156, which will not introduce any hydrocarbons, e.g. Bev-A-Line IV available from Cole Parmer, Chicago, or Teflon, to disconnect coupling 154 which is connected to a rigid tube carried by the print head 28. The tube 158 passes through a support member 160 and is connected to the input side of a particulate filter 162. Referring to FIG. 3, the output side of the filter 162 is connected to an aperture 164 located at one end of the oblong central cavity 82 in the frame 80. The aperture 164 delivers dehumidified air into the enclosed chamber formed by the cavity 82, opening 86 and the cut-out 90 in the rear frame member 88. The dehumidified air flows around the sides of the corona shield 78 and passes through the gap between the corona shield and the aperture mask 94 to the interior of the corona shield, where it surrounds the corona wire 76 in the course of passing out of the print head through the apertures 96, 98 and the slotted mask 108.

The flow of dehumidified air through the electrostatic print head 28 has been found to retard the buildup of ammonium nitrate on the corona wire 76, and in and around the electrically controlled apertures 96, 98, to a point where the useful life of the print head can be extended by an order of magnitude. This represents an enormous increase over the average lifetime of a print head not supplied with dehumidified air, which is typically about 75 hours. The following examples, provided merely by way of illustration and not being intended as limitations on the scope of the invention, will assist in an understanding of the invention and the manner in which these advantageous results are obtained.

EXAMPLE 1

A test was conducted to determine the effect of dried air on the lifetime of electrostatic print heads. An apparatus was constructed which was capable of testing four print heads in parallel. Print performance was assessed quantitatively by measuring print quality as a function of time.

Figure 6:
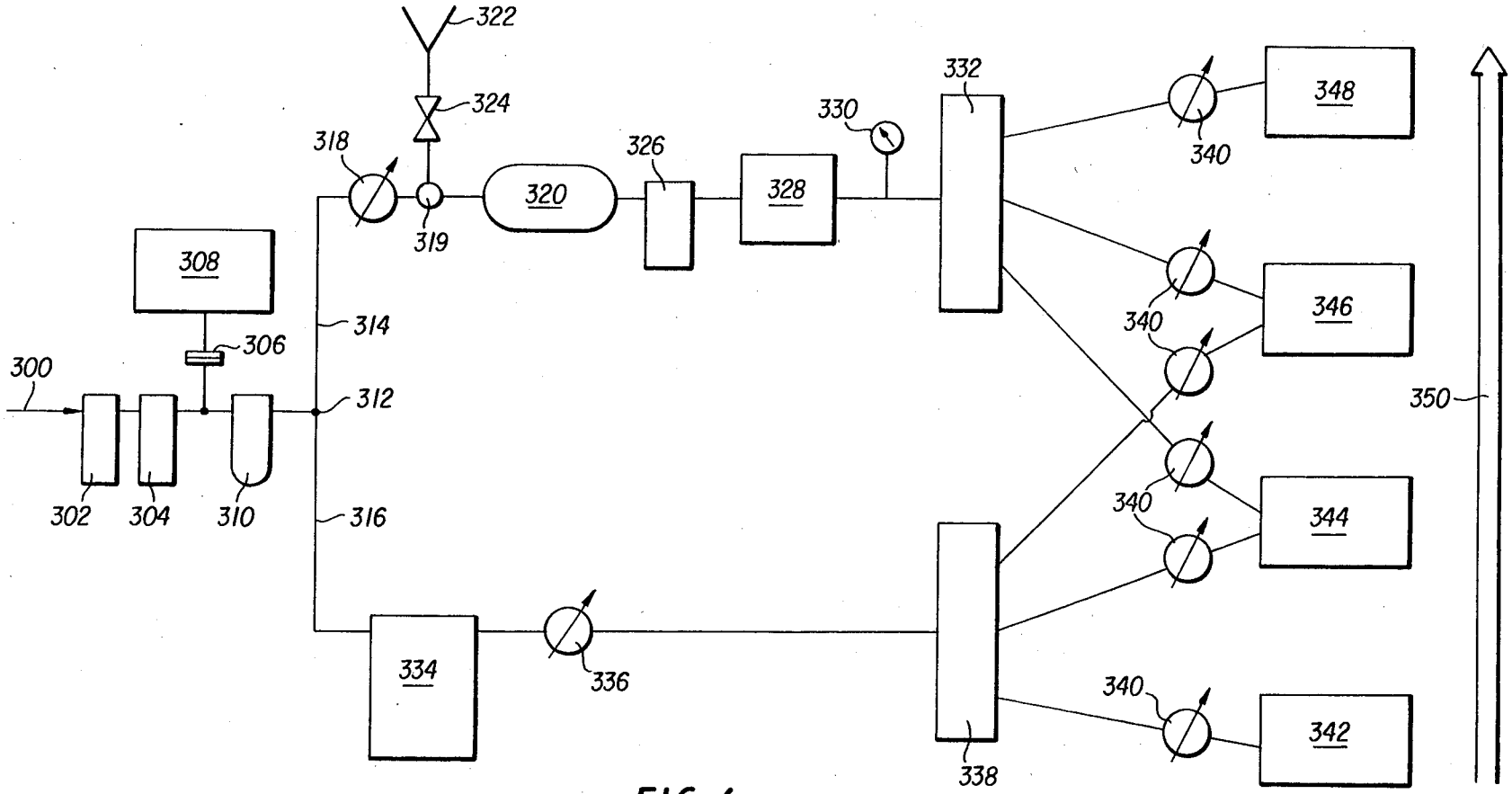
FIG. 6 is a schematic diagram of a test apparatus used to determine the effect of dehumidified air on the lifetime of electrostatic print heads.

A schematic diagram of the test apparatus used is shown in FIG. 6. Referring to FIG. 6, compressed air at about 100 psi entered the apparatus through tubing 300. All tubing used to connect the components of the apparatus was Bev-A-Line IV tubing. Tubing 300 was connected to coalescing oil filter 302 (Wilkerson F20-02-F00) and coalescing oil filter 304 (Wilkerson M20-20-F00) which were used to remove oil and water droplets present in the source of compressed air. A pressure switch 306 stopped power to the print heads from power source 308 in the event of air supply failure. The coalescing oil filters were connected to a charcoal filter 310 (Balston C1-150-19) which was used to remove oil or water droplets in the air. The charcoal filter was connected by a Tee joint 312 to the "wet" side of the apparatus 314 and to the "dry" side of the apparatus 316.

On the wet side 314, the Tee joint was connected first to a regulator 318 (0–60 psi) which permitted the air flow on the wet side to be balanced with that on the dry side. Regulator 318 was connected to humidifier 320, which consisted of a steel tank, about 12 inches in diameter and about 24 inches long and having rounded ends, through a three-way valve 319. Air entered and exited the tank coaxially at the ends. Water was added to the humidifier 320 by means of funnel 322 and valve 324, through three-way valve 319. Entering air became humidified by picking up water contained in the tank. The humidifier 320 was connected to a coalescing filter 326 (Balston Type BX) which was used to remove liquid water droplets from the humidifier and allow water vapor to pass through. Filter 326 was connected to a hygrometer in a pressurized box 328, which permitted quick measurement of the humidity in the humid air stream. Because it was pressurized, the humidity at atmospheric pressure was calculated from the pressure (P) and the relative humidity (RH) measured at pressure according to the following relationship:

$$\frac{P\ \text{measurement}}{P\ \text{atmospheric}} = \frac{\%\ RH\ \text{measurement}}{\%\ RH\ \text{atmospheric}}$$

Pressure gage 330 facilitated the above calculation. Hygrometer 328 was connected to wet air distribution manifold 332.

On the dry side 316, the Tee joint 312 was connected to air dryer 334 (O'Keefe Model OKC-079-2). Air dryer 334 was connected to a regulator 336 of the type used for regulator 318 on the wet side of the apparatus. Regulator 336 was connected to dry air distribution manifold 338. Wet air distribution manifold 332 and dry air distribution manifold 338 were connected through six identical flow meters 340 (Dwyer Rate Master Type RMA-8-SSV, 0–100 scfh flow). Flow meters 340 controlled the air flow to print head 342, print head 344, print head 346, and print head 348. All four print heads were of the type shown in FIGS. 3 and 4. The percent relative humidity (% RH) to print heads 344 and 346 was controlled by controlling the relative amounts of wet and dry air from manifolds 332 and 338, respectively. Arrow 350 points in the direction of increasing humidity.

In order to assess the changes in print quality over a period of time due to the effect of the air humidity, prints were made periodically using the print heads and the decrease in image density was observed. Image density in an area is a function of charge density deposited by the print head in that area. Deposited charge density decreases as a function of aperture occlusion by the ammonium nitrate crystals which form as a result of the water in the air supplied to the print head. Therefore, measurement of image density uniformity will characterize the degree to which water in the air supply is degrading the print quality. Another indication of the buildup of ammonium nitrate crystals is the gradual increase in voltage needed to maintain a constant current from the corona wire to the mask and corona shield. This current was periodically measured.

Test prints were made periodically to permit measurement of image density. A portion of the test print was solid black which was printed by allowing all of the apertures to print. Such a test print allowed the assessment of the degree of occlusion of the apertures across the width of the print head by measurement of the relative image density across the print. Since print head to print head variations are possible, each print head was compared to itself for a valid test.

The corona voltage of all four print heads was adjusted to give a total current of 200 $\mu$A to both mask and shield and was maintained at that value. Voltage readings are set forth in Table 1 below:

TABLE 1

| Print Head | Corona KV |
|---|---|
| 1 | 2.50 |
| 2 | 2.50 |
| 3 | 2.42 |
| 4 | 2.49 |

Several test prints were made from each print head and saved.

The test apparatus was placed in a room having a controlled temperature of 70° F. (21.1° C.). The compressed air in tubing 300 had a dew point of 20° F. (−6.6° C.). The humidity of air coming out of the humidifier 320 at equilibrium is a function of the temperature of the room and the flow rate which is held constant. The humidifier 320 was allowed to equilibrate to the room temperature and flow conditions used. The equilibrium point was about 55% RH at 6 psig and 72° F. (22.2° C.). This corresponded to 39% RH at atmospheric pressure for air from the humidifier. The four print heads were to be tested under the following conditions:

Print Head 342—very dry air from the air dryer; essentially 0% RH

Print Head 344—5% RH

Print Head 346—10% RH; This was selected to represent the absolute best conditions for year round operation without a dryer.

Print Head 348—very wet air; 100% humidified air of about 39% RH

In order to obtain those various humidities, the six flow meters 340 were set as follows:

Print Head 342—dry air (60 scfh)

Print Head 344–dry air (52 scfh) wet air (8 scfh)

Print Head 346—dry air (45 scfh) wet air (15 scfh)

Print Head 348—wet air (60 scfh)

Test prints were made periodically by removing the print heads from the test apparatus and inserting them in a Markem Model 7000 electrostatic printer. Attempts were made to maintain the same roll of dielectric paper and toner lot. All four print heads were turned on at 16:20 hours on day 1 of the test. The pressure reading on the hygrometer was increased to 15 psig.

At 07:25 hours on day 2, the test was stopped because the humidity of the air coming out of the humidifier had equilibrated overnight at 59% RH at 15 psig for an atmospheric relative humidity of about 30%. This was considered to be too low as the maximum relative humidity for the test. In order to increase the humidity of air from the humidifier, the flow rate through the humidifier was decreased in order to increase the residence time of the air in the humidifier. The flow through the humidifier was decreased by decreasing the flow through the masks. The flow meters to print heads 344 and 346 having a range of 0–100 scfh were not calibrated finely enough to accurately meter the humidified air to these print heads. A flow meter having a range of 0–5 scfh was used for print head 344 and a flow meter having a range of 0–10 scfh was used for print head 346.

At 15:41 hours on day 2, the print heads were restarted. Equilibrium was reached at 60% RH at 5 psig, which corresponds to about 45% at standard pressure. The flow rates were set as follows:

Print Head 342 (dry)—dry air (30 scfh)

Print Head 344 (5% RH)—dry air (27 scfh) wet air (3.3 scfh)

Print Head 346 (10% RH)—dry air (23 scfh) wet air (6.6 scfh)

Print Head 348 (45% RH)—wet air (30 scfh)

The data for the four print heads tested are set forth in Tables 2–5 below:

TABLE 2

| Print Head 342 | | |
|---|---|---|
| Elapsed Hours | Corona KV | Comments |
| 0 | 2.50 | |
| 33.2 | 2.46 | |

TABLE 2-continued

| Print Head 342 | | |
|---|---|---|
| Elapsed Hours | Corona KV | Comments |
| 63.4 | 2.49 | 60% RH @ 5 psig, 70° F. |
| 87.5 | 2.49 | 60% RH @ 5 psig, 74° F. |
| 109.7 | 2.50 | 60% RH @ 5 psig, 75° F. |
| 128.2 | 2.51 | 60% RH @ 5 psig, 71° F. |
| 153.4 | 2.50 | 59% RH @ 5 psig, 72° F. |
| 194.2 | 2.51 | 56.5% RH @ 5 psig, 74° F. |
| 214.4 | 2.52 | 57% RH @ 4 psig, 74° F. |
| 254.1 | 2.50 | 60% RH @ 4 psig, 72° F. |
| 281.9 | 2.50 | 56.5% RH @ 4 psig, 71° F. |
| 346.2 | 2.49 | 52% RH @ 4 psig, 75° F. |
| 384.2 | 2.50 | 58% RH @ 4 psig, 71° F. |
| 406.0 | 2.50 | 62% RH @ 5 psig, 74° F. |
| 434.8 | 2.51 | 59% RH @ 5 psig, 73° F. |
| 463.1 | 2.50 | 54% RH @ 5 psig, 75° F. |
| 486.4 | 2.50 | 55% RH @ 5 psig, 73° F. |
| 500.8 | 2.51 | 56% RH @ 5 psig, 73° F. |
| 508.3 | 2.50 | 53% RH @ 4.75 psig, 74° F. |
| 532.8 | 2.49 | 53% RH @ 4.5 psig, 73° F. |
| 556.0 | 2.47 | 52% RH @ 4.5 psig, 73° F. |
| 578.6 | 2.49 | 54% RH @ 5 psig, 73° F. |
| 594.8 | 2.49 | 56% RH @ 5 psig, 73° F. |
| 649.9 | 2.50 | 51% RH @ 4.75 psig, 74° F. |
| 688.8 | 2.53 | 52% RH @ 5 psig, 73° F. |
| 695.3 | 2.52 | 52% RH @ 5 psig, 73° F. |
| 716.5 | 2.50 | 50% RH @ 5 psig, 76° F. |
| 772.9 | 2.50 | 49% RH @ 4.75 psig, 75° F. |

TABLE 3

| Print Head 344 | | |
|---|---|---|
| Elapsed Hours | Corona KV | Comments |
| 0 | 2.50 | |
| 33.1 | 2.49 | |
| 63.0 | 2.52 | 60% RH @ 5 psig, 70° F. |
| 87.3 | 2.53 | 60% RH @ 5 psig, 74° F. |
| 109.5 | 2.54 | 60% RH @ 5 psig, 75° F. |
| 127.8 | 2.56 | 60% RH @ 5 psig, 71° F. |
| 152.8 | 2.54 | 59% RH @ 5 psig, 72° F. |
| 193.3 | 2.55 | 56.5% RH @ 5 psig, 74° F. |
| 213.4 | 2.55 | 57% RH @ 4 psig, 74° F. |
| 252.9 | 2.54 | 60% RH @ 4 psig, 72° F. |
| 280.4 | 2.53 | 56.5% RH @ 4 psig, 71° F. |
| 344.1 | 2.53 | 52% RH @ 4 psig, 75° F. |
| 381.7 | 2.53 | 58% RH @ 4 psig, 71° F. |
| 403.3 | 2.53 | 62% RH @ 5 psig, 74° F. |
| 431.9 | 2.53 | 59% RH @ 5 psig, 73° F. |
| 459.9 | 2.53 | 54% RH @ 5 psig, 75° F. |
| 483.1 | 2.54 | 55% RH @ 5 psig, 73° F. |
| 497.4 | 2.55 | 56% RH @ 5 psig, 73° F. |
| 504.9 | 2.53 | 53% RH @ 4.75 psig, 74° F. |
| 529.2 | 2.53 | 53% RH @ 4.5 psig, 73° F. |
| 552.2 | 2.51 | 52% RH @ 4.5 psig, 73° F. |
| 574.7 | 2.53 | 54% RH @ 5 psig, 73° F. |
| 590.7 | 2.53 | 56% RH @ 5 psig, 73° F. |
| 645.4 | 2.55 | 51% RH @ 4.75 psig, 74° F. |
| 684.1 | 2.55 | 52% RH @ 5 psig, 73° F. |
| 690.6 | 2.55 | 52% RH @ 5 psig, 73° F. |
| 711.6 | 2.55 | 50% RH @ 5 psig, 76° F. |
| 767.5 | 2.53 | 49% RH @ 4.75 psig, 75° F. |

TABLE 4

| Print Head 346 | | |
|---|---|---|
| Elapsed Hours | Corona KV | Comments |
| 0 | 2.42 | |
| 32.9 | 2.48 | |
| 62.8 | 2.50 | 60% RH @ 5 psig, 70° F. |
| 87.3 | 2.51 | 60% RH @ 5 psig, 74° F. |
| 109.4 | 2.52 | 60% RH @ 5 psig, 75° F. |
| 127.7 | 2.54 | 60% RH @ 5 psig, 71° F. |
| 152.6 | 2.52 | 59% RH @ 5 psig, 72° F. |
| 192.8 | 2.53 | 56.5% RH @ 5 psig, 74° F. |
| 212.9 | 2.54 | 57% RH @ 4 psig, 74° F. |

TABLE 4-continued

| Elapsed Hours | Corona KV | Comments |
|---|---|---|
| | Print Head 346 | |
| 252.2 | 2.52 | 60% RH @ 4 psig, 72° F. |
| 279.7 | 2.51 | 56.5% RH @ 4 psig, 71° F. |
| 343.3 | 2.52 | 52% RH @ 4 psig, 75° F. |
| 380.8 | 2.51 | 58% RH @ 4 psig, 71° F. |
| 402.5 | 2.52 | 62% RH @ 5 psig, 74° F. |
| 431.0 | 2.55 | 59% RH @ 5 psig, 73° F. |
| 458.9 | 2.52 | 54% RH @ 5 psig, 75° F. |
| 482.0 | 2.54 | 55% RH @ 5 psig, 73° F. |
| 496.3 | 2.54 | 56% RH @ 5 psig, 73° F. |
| 503.7 | 2.52 | 53% RH @ 4.75 psig, 74° F. |
| 527.9 | 2.52 | 53% RH @ 4.5 psig, 73° F. |
| 550.8 | 2.51 | 52% RH @ 4.5 psig, 73° F. |
| 573.2 | 2.50 | 54% RH @ 5 psig, 73° F. |
| 589.3 | 2.50 | 56% RH @ 5 psig, 73° F. |
| 643.7 | 2.51 | 51% RH @ 4.75 psig, 74° F. |
| 682.3 | 2.51 | 52% RH @ 5 psig, 73° F. |
| 688.8 | 2.51 | 52% RH @ 5 psig, 73° F. |
| 710.0 | 2.51 | 50% RH @ 5 psig, 76° F. |
| 765.2 | 2.49 | 49% RH @ 4.75 psig, 75° F. |

TABLE 5

| Elapsed Hours | Corona KV | Comments |
|---|---|---|
| | Print Head 348 | |
| 0 | 2.49 | |
| 33.0 | 2.57 | |
| 63.0 | 2.66 | 60% RH @ 5 psig, 70° F. |
| 87.4 | 2.69 | 60% RH @ 5 psig, 74° F. |
| 109.5 | 2.69 | 60% RH @ 5 psig, 75° F. |
| 127.8 | 2.69 | 60% RH @ 5 psig, 71° F. |
| 152.7 | 2.68 | 59% RH @ 5 psig, 72° F. |
| 193.0 | 2.70 | 56.5% RH @ 5 psig, 74° F. |
| 213.1 | 2.70 | 57% RH @ 4 psig, 74° F. |
| 253.4 | 2.68 | 60% RH @ 4 psig, 72° F. |
| 279.9 | 2.66 | 56.5% RH @ 4 psig, 71° F. |
| 343.4 | 2.69 | 52% RH @ 4 psig, 75° F. |
| 380.9 | 2.68 | 58% RH @ 4 psig, 71° F. |
| 402.6 | 2.68 | 62% RH @ 5 psig, 74° F. |
| 431.1 | 2.70 | 59% RH @ 5 psig, 73° F. |
| 459.1 | 2.68 | 54% RH @ 5 psig, 75° F. |
| 482.2 | 2.70 | 55% RH @ 5 psig, 73° F. |
| 496.5 | 2.70 | 56% RH @ 5 psig, 73° F. |
| 504.0 | 2.68 | 53% RH @ 4.75 psig, 74° F. |
| 528.2 | 2.71 | 53% RH @ 4.5 psig, 73° F. |
| 551.1 | 2.69 | 52% RH @ 4.5 psig, 73° F. |
| 573.5 | 2.71 | 54% RH @ 5 psig, 73° F. |
| 589.6 | 2.70 | 56% RH @ 5 psig, 73° F. |
| 644.1 | 2.72 | 51% RH @ 4.75 psig, 74° F. |
| 682.6 | 2.72 | 52% RH @ 5 psig, 73° F. |
| 689.1 | 2.73 | 52% RH @ 5 psig, 73° F. |
| 710.0 | 2.73 | 50% RH @ 5 psig, 76° F. |

TABLE 5-continued

| Elapsed Hours | Corona KV | Comments |
|---|---|---|
| | Print Head 348 | |
| 765.8 | 2.70 | 49% RH @ psig, 75° F. |

Although most of the print quality from print head 344 was uniform, a band of apertures about 2 cm wide did not print. The print head was removed from the test apparatus and examined. Ammonium nitrate had built up on both the inside and the outside of the apertures in that band. The remainder of the mask was clear of obstructions and printed well.

In order to quantitatively measure the print quality, the optical densities of the printed images from the four print heads were measured. The instrument used for this purpose was a Welch Densichron Model 1 photometer with a Model 3832A reflection unit measuring head. This instrument illuminated the printed image with a light and measured the reflected light from a spot approximately ⅛ inch in diameter.

The instrument was allowed to warm up and was adjusted to read 100% reflected on a standard white glass tile and 0% transmitted on a standard black glass tile. The clear filter was used. Readings were taken of the printed images and the variations of the reflectance across the image.

TABLE 6

| Elasped Hours | Print Head 342 | | | Print Head 344 | | | Print Head 346 | | | Print Head 348 | | |
|---|---|---|---|---|---|---|---|---|---|---|---|---|
| 0 | 17 | 0.41 | 41 | 4 | 0.29 | 14 | 3 | 0.20 | 15 | 5 | 0.20 | 25 |
| | 0.77 | 1.97 | 0.39 | 1.40 | 1.65 | 0.85 | 1.52 | 1.85 | 0.82 | 1.30 | 2.17 | 0.60 |
| 63 | 12 | 0.35 | 34 | 7 | 0.50 | 14 | 6 | 0.32 | 19 | 4 | 0.09 | 44 |
| | 0.92 | 1.96 | 0.47 | 1.15 | 1.35 | 0.85 | 1.22 | 1.69 | 0.72 | 1.40 | 3.89 | 0.36 |
| 194 | 25 | 0.63 | 40 | 4 | 0.05 | 81 | 12 | 0.41 | 29 | 10 | 0.19 | 53 |
| | 0.60 | 1.50 | 0.40 | 1.40 | 15.6 | 0.9 | 0.92 | 1.70 | 0.54 | 1.0 | 3.57 | 0.28 |
| 406 | 17 | 0.41 | 41 | 7 | 0.07 | 100 | 12 | 0.5 | 24 | 13 | 0.28 | 47 |
| | 0.77 | 1.97 | 0.39 | 1.15 | 0.0 | 0.0 | 0.92 | 1.48 | 0.62 | .89 | 2.70 | 0.33 |
| 595 | 17 | 0.40 | 42 | 7 | 0.07 | 100 | 11 | 0.26 | 42 | 18 | 0.19 | 93 |
| | 0.77 | 2.03 | 0.38 | 1.15 | 0.0 | 0.0 | 0.96 | 2.53 | 0.38 | 0.74 | 24.67 | 0.03 |
| 773 | 19 | 0.40 | 47 | 5 | 0.05 | 100 | 10 | 0.25 | 40 | 11 | 0.11 | 98 |
| | 0.72 | 2.18 | 0.33 | 1.30 | 0.0 | 0.0 | 1.0 | 2.50 | 0.40 | 0.96 | 96 | 0.01 |

The optical density data is set forth in Table 6 above in the following format:

% Reflectance (min) $\frac{\%\ R\ (min)}{\%\ R\ (max)}$ % Relectance (max)

Optical Density (min) $\frac{O.D.\ (min)}{O.D.\ (max)}$ Optical Density (max)

The four print heads were run for about 773 hours under the four different humidity conditions. The data was reviewed in an effort to determine the level of dehumidification required to achieve a print head life of 300 hours with good print quality. The values for percent relative humidity were initially selected based on the belief that they would bracket the 300-hour mark. Periodic print tests as well as measurements of the corona voltage, shield current and mask current were made. The following results for the four print heads were obtained:

Print Head 342—(very dry air) The print tests showed that this print head had substantially unchanged print quality throughout the 773-hour test.

Print Head 344—(nominal 5% RH) This print head showed an anomolous area of light print which was probably due to print head geometry with a self-reinforcing cycle of ammonium nitrate formation, which began to manifest itself about 150 hours into the test. The remainder of the printed image appeared very uniform with no substantial degradation of print quality after 773 hours.

Print Head 346—(nominal 10% RH) This print head showed reasonable print quality beyond 300 hours, although at over 700 hours the print quality and uniformity were not as good as the prints of print head 342 or of the unaffected portion of print head 344.

Print Head 348—(nominal 40% RH) The performance of this print head was unacceptable. The print quality was very non-uniform even after only 63 hours of operation.

Figure 7:
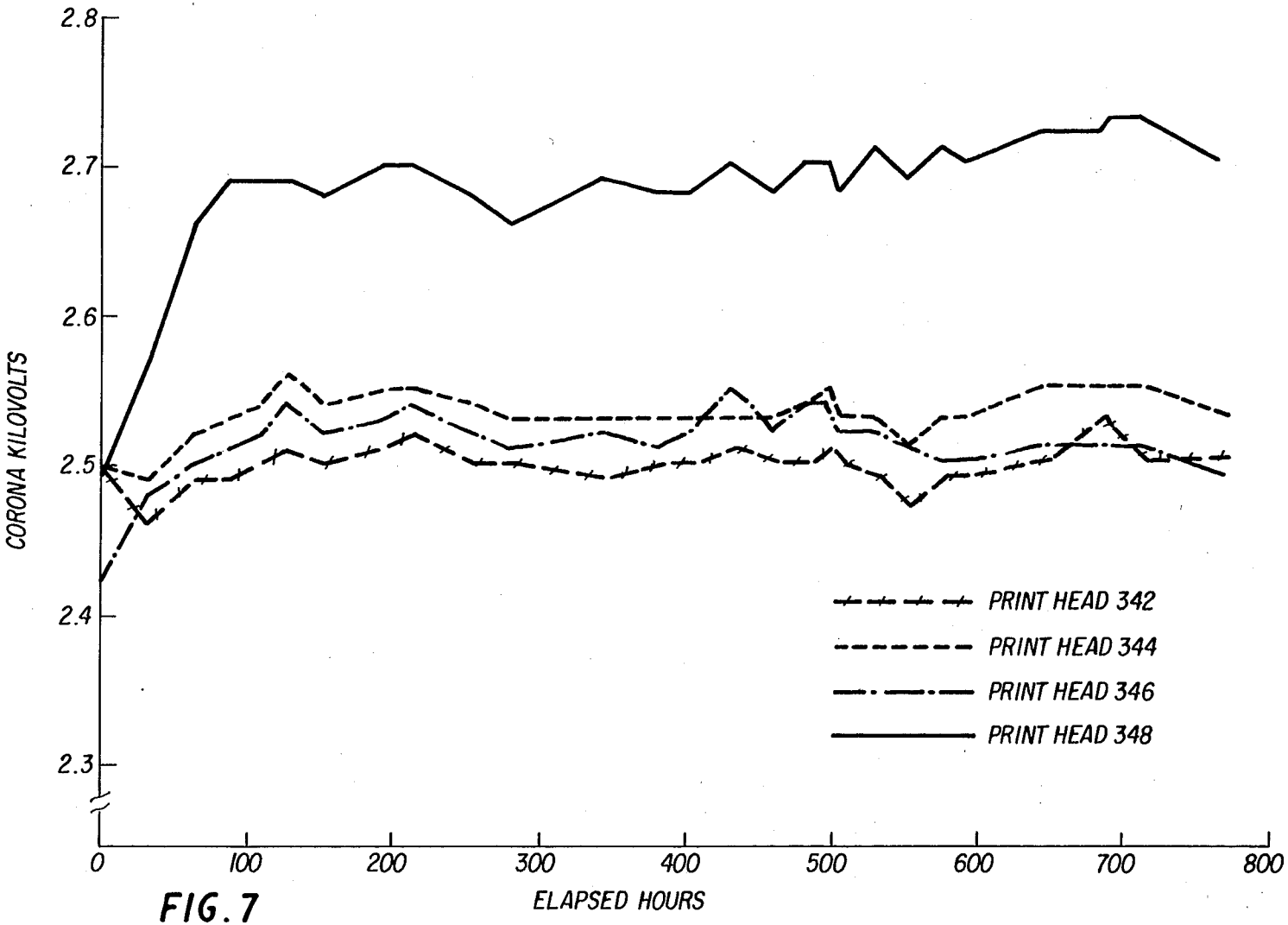
FIG. 7 is a plot of corona kilovolts versus elapsed hours based on the data presented in Example 1 below.

The change in corona voltage over time was found to be a good indication of the buildup of ammonium nitrate, and therefore, of the print quality from the mask. The data for corona voltage are set forth in Tables 2–5 above. A plot of corona kilovolts versus elapsed hours appears in FIG. 7. The corona voltages for print heads 342, 344 and 346 were approximately the same, while the corona voltage for print head 348 quickly rose to the limit imposed by the current limited power supply. The corona voltage would have gone higher without this limit.

The optical tests which was conducted in an effort to quantify the print quality as a function of time indicated that the images printed by print heads 342 and 344 (with the exception of the anomolous region) and 346 were very similar. One reasonable measure of print uniformity is the ratio of the reflectance of the least reflective area on the print to the reflectance of the most reflective area. If the print were perfectly uniform, this ratio would be equal to 1, since there would be no difference between the most and the least reflective areas. At the conclusion of the test, the values of this ratio for the four print heads were as follows:

Print Head 342—0.43
Print Head 344—0.17
Print Head 346—0.32
Print Head 348—0.18

If print head 344 had not performed so anomolously, its ratio would probably be between those of print heads 342 and 346, so that the drier the air flowing through the print head, the more uniform the prints produced by that print head.

This test demonstrated that satisfactory print quality and uniformity can be obtained at 300 hours by passing air at 10% RH or less through the print head and that drier air can extend the lifetime of the print head far beyond this point, whereas air at 40% RH leads to substantial non-uniformity of the print at only 63 hours.

EXAMPLE 2

A second test was conducted to expand the range of relative humidities of the air flowing through the print heads. One of the four print heads in this test was run with very dry air and the others were run with air having relative humidities of 10%, 20% and 30%. The test apparatus of FIG. 6 was changed slightly to accommodate the different range of flow rates by installing more accurate flow meters. In this test, the air flow to the various print heads was adjusted each time the humidity and the pressure of the humidified air source was checked. This permitted more accurate long term testing regardless of the drift in the humidity of the air going through the system.

The print heads used in Example 1 were cleaned and the aperture mask in print head 344 was replaced. New corona wires were installed. Each print head was adjusted to have a combined mask and shield current of 200 μA. The four print heads were tested under the following conditions:

Print Head 342—essentially 0% RH dry air; (30 scfh)
Print Head 344—nominal 10% RH; dry air (24 scfh) wet air (6 scfh)
Print Head 346—nominal 20% RH; dry air (19 scfh) wet air (11 scfh)
Print Head 348—nominal 30% RH; dry air (13 scfh) wet air (17scfh)

Test prints were made periodically as described in Example 1 above.

The data for the four print heads tested are set forth in Tables 7–10 below:

TABLE 7

| Print Head 342 | | |
|---|---|---|
| Elapsed Hours | Corona KV | % RH @ Atmos. P |
| 0 | 2.51 | 53 |
| 29.0 | 2.50 | 54 |
| 53.7 | 2.50 | 52 |
| 81.3 | 2.47 | 49 |
| 105.5 | 2.47 | 48.7 |
| 163.9 | 2.48 | 52.2 |
| 191.5 | 2.49 | 49.9 |
| 230.3 | 2.48 | 46.8 |
| 295.8 | 2.49 | 43.6 |
| 319.7 | 2.51 | 48.6 |
| 360.1 | 2.50 | 51.5 |
| 407.0 | 2.50 | 50.7 |

TABLE 8

| Print Head 344 | | |
|---|---|---|
| Elapsed Hours | Corona KV | % RH @ Atmos. P |
| 0 | 2.49 | 53 |
| 28.9 | 2.50 | 54 |
| 53.5 | 2.51 | 52 |
| 81.0 | 2.49 | 49 |
| 104.9 | 2.49 | 48.7 |
| 163.0 | 2.49 | 52.2 |
| 190.4 | 2.49 | 49.9 |
| 229.1 | 2.49 | 46.8 |
| 294.1 | 2.51 | 43.6 |
| 317.8 | 2.52 | 48.6 |
| 358.0 | 2.51 | 51.5 |
| 404.5 | 2.50 | 50.7 |

TABLE 9

| Print Head 346 | | |
|---|---|---|
| Elapsed Hours | Corona KV | % RH @ Atmos. P |
| 0 | 2.50 | 53 |
| 28.6 | 2.52 | 54 |
| 53.0 | 2.54 | 52 |
| 80.3 | 2.52 | 49 |
| 104.1 | 2.52 | 48.7 |
| 162.0 | 2.53 | 52.2 |
| 189.1 | 2.53 | 49.9 |
| 227.4 | 2.53 | 46.8 |
| 292.2 | 2.55 | 43.6 |
| 315.7 | 2.56 | 48.6 |
| 355.6 | 2.55 | 51.5 |
| 401.9 | 2.55 | 50.7 |

TABLE 10

| Elapsed Hours | Corona KV | % RH @ Atmos. P |
|---|---|---|
| 0 | 2.52 | 53 |
| 28.7 | 2.56 | 54 |
| 53.2 | 2.58 | 52 |

TABLE 10-continued

| Elapsed Hours | Corona KV | % RH @ Atmos. P |
|---|---|---|
| 80.7 | 2.56 | 49 |
| 104.6 | 2.57 | 48.7 |
| 162.5 | 2.59 | 52.2 |
| 189.7 | 2.61 | 49.9 |
| 228.4 | 2.61 | 46.8 |
| 293.4 | 2.64 | 43.6 |
| 317.0 | 2.66 | 48.6 |
| 357.0 | 2.66 | 51.5 |
| 403.5 | 2.67 | 50.7 |

Figure 8:
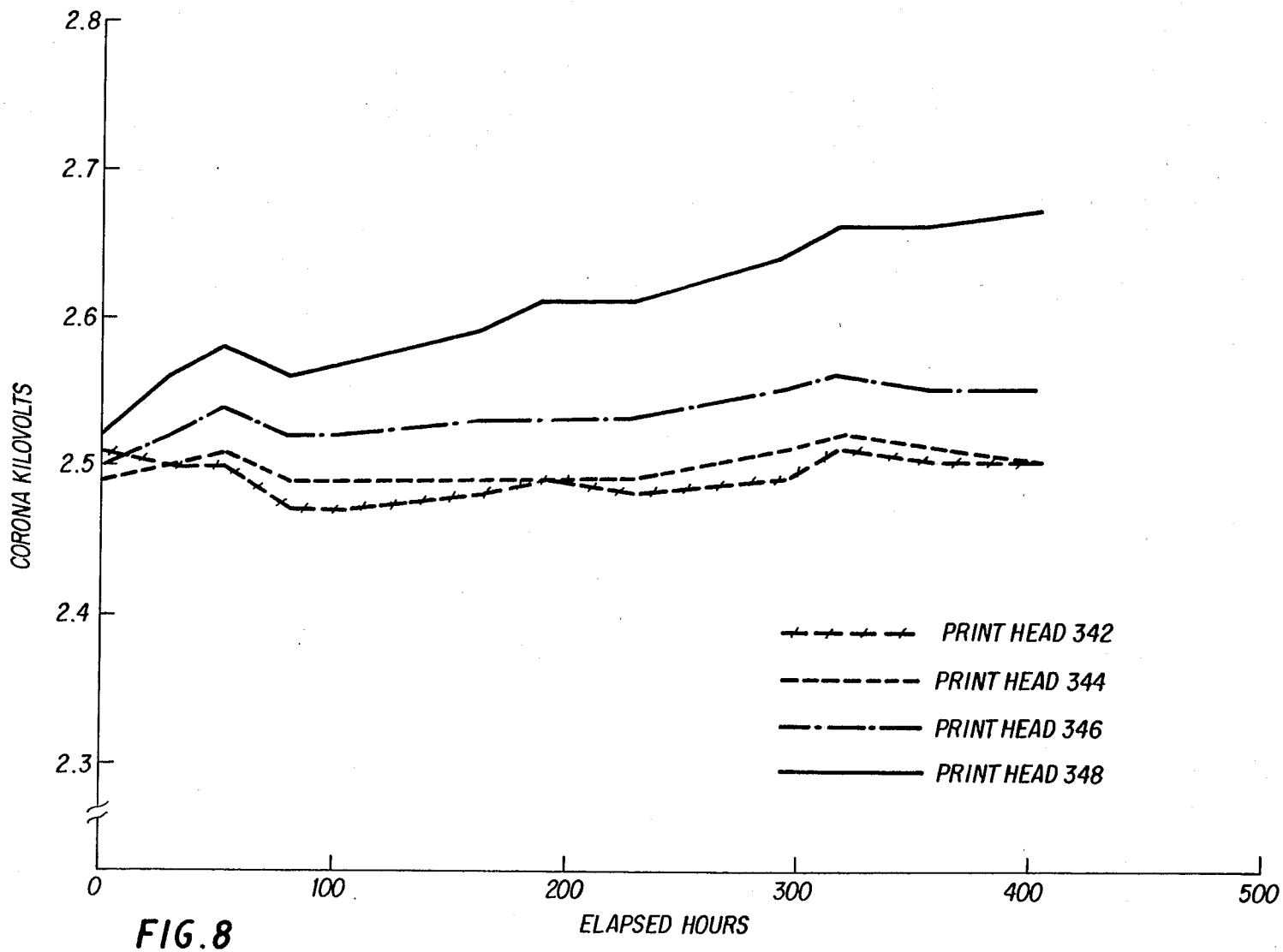
FIG. 8 is a plot of corona kilovolts versus elapsed hours based on the data presented in Example 2 below.

The rresults of the print tests and a comparison of the corona voltages for the four print heads over time indicates a clear difference in print head performance at different percent relative humidities of the air flowing through the print heads. The measurement of corona voltage versus time is especially significant. Corona voltage has historically been a measure of cleanliness of the print head, since the corona voltage needed to maintain the same current increases as contaminants buildup. A plot of corona kilovolts versus elapsed hours based on the data set forth in Tables 7–10 above appears in FIG. 8.

As in Example 1 above, print head 344 showed some anomolous results, even though the aperture mask was replaced. This is probably due to a geometric feature of this particular print head. It was observed that one side of the printed image became lighter due to the buildup of ammonium nitrate in part of the mask.

Disregarding the anomolous results from print head 344, print head 348 (30% RH) was the first one to show a lightening of the print on the edge of the image. This lightening was readily apparent at 106 hours. Print head 346 (20% RH) began to show a lightening at the edge of the printed image at 164 hours, which became very evident by 296 hours. By contrast, in the case of print head 342 (very dry air—dew point $< -50°$ F.), there was no perceptible difference in appearance of the printed image even after 407 hours of operation. Therefore, the lifetime of a print head is a function of the degree of dehumidification of the air passing through the print head.

For the purpose of printing with an electrostatic print head of the type used in the Examples, a lifetime of less than about 300 hours has been deemed to be unacceptable. This lifetime was selected as desirable even though the use of this type of print head without any dehumidification of the air, at a relative humidity of 50–60 percent, will generally only maintain print quality and uniformity for about 60 hours. As shown by these tests, acceptable print quality for about 300 hours of operation can be obtained if the air flowing through the print head has a relative humidity of less than about 20 percent, and preferably less than 5 percent. There appears to be no lower limit for the humidity of the air that will result in acceptable print quality within the limits of economically reasonable drying equipment.

If a print head were to be designed which was less expensive to manufacture or service than those employed in the Examples, a relative humidity higher than 20 percent may be found to be acceptable. Although the lifetime of the print head would be shorter at higher percent relative humidity, the print head could be economically replaced at the end of its shorter lifetime.

What is claimed is:

1. An electrostatic print head system comprising:

(a) an ion modulated electrostatic print head, (b) a means for supplying unheated dehumidified air having a relative humidity of less than about 20 percent at or near ambient temperature, and (c) a means for directing the dehumidified air at, near or through the print head.

2. The electrostatic print head system of claim 1 wherein supply means (b) is capable of supplying unheated dehumidified air having a relative humidity of less than about 5 percent at or near ambient temperature.

3. The electrostatic print head system of claim 1 wherein the print head comprises a modulated aperture board having a plurality of selectively controlled apertures therein, and an ion generator for providing ions for electrostatic projection through the apertures, and wherein the dehumidified air can be directed to flow at or near the ion generator and at, near or through the apertures.

4. The electrostatic print head system of claim 3 wherein the apertures function to cut off the flow of ions, and wherein the ion generator is a corona wire.

5. An electrostatic printer comprising:

(a) an ion modulated electrostatic print head for forming latent electrostatic images, (b) a means for developing the latent electrostatic images, (c) a means for supplying unheated dehumidified air having a relative humidity of less than about 20 percent at or near ambient temperature, and (d) a means for directing the dehumidified air at, near or through the print head.

6. The electrostatic printer of claim 5 wherein supply means (b) is capable of supplying unheated dehumidified air having a relative humidity of less than about 5 percent at or near ambient temperature.

7. The electrostatic printer of claim 5 wherein the printer comprises a modulated aperture board having a plurality of selectively controlled apertures therein, and an ion generator for providing ions for electrostatic projection through the apertures, and wherein the dehumidified air can be directed to flow at or near the ion generator and at, near or through the apertures.

8. The electrostatic printer of claim 7 wherein the apertures function to cut off the flow of ions, and wherein the ion generator is a corona wire.

9. An electrostatic imaging process which comprises the steps of:

(a) forming a latent electrostatic image on a dielectric imaging surface using an ion modulated electrostatic print head, (b) developing the latent electrostatic image, (c) providing unheated dehumidified air having a relative humidity of less than about 20 percent at or near ambient temperature, and (d) directing the dehumidified air at, near or through the print head.

10. The electrostatic imaging process of claim 9 wherein the print head comprises a modulated aperture board having a plurality of selectively controlled apertures therein, and an ion generator for providing ions for electrostatic projection through the apertures, and wherein the dehumidified air is directed at or near the ion generator and at, near or through the apertures.

11. The electrostatic imaging process of claim 10 wherein the apertures function to cut off the flow of ions, and wherein the ion generator is a corona wire.

12. The electrostatic imaging process of claim 9 wherein the dehumidified air has a relative humidity of less than about 5 percent at or near ambient temperature.

* * * * *